US005704517A

United States Patent [19]

Lancaster, Jr.

[11] Patent Number: 5,704,517

[45] Date of Patent: *Jan. 6, 1998

[54] ENCLOSURE FOR HOUSING AND DISPLAYING A PUBLIC TELEPHONE AND FOODSTUFF VENDING MACHINE

[75] Inventor: Hazen G. Lancaster, Jr., Cary, N.C.

[73] Assignee: Triangle Telephone Company, Cary, N.C.

[ * ] Notice: The term of this patent shall not extend beyond the expiration date of Pat. No. D. 368,907.

[21] Appl. No.: 493,451

[22] Filed: Jun. 23, 1995

[51] Int. Cl.[6] ..... B67D 5/10

[52] U.S. Cl. ..... 222/2; 222/192; 222/368

[58] Field of Search ..... 222/2, 154, 183, 222/192, 132, 368, 342, 349; 379/91, 143, 144, 155; 52/27.5; D14/144, 146; 221/199

[56] References Cited

U.S. PATENT DOCUMENTS

| | | | |
|---|---|---|---|
| Re. 16,843 | 1/1928 | Kurtz . | |
| D. 185,365 | 5/1959 | Johnston . | |
| D. 317,629 | 6/1991 | Chalabian . | |
| D. 318,493 | 7/1991 | Chalabian . | |
| D. 323,656 | 2/1992 | McGarvey et al. . | |
| D. 332,285 | 1/1993 | Bolen . | |
| D. 368,907 | 4/1996 | Lancaster, Jr. | D14/144 |
| 3,338,002 | 8/1967 | Ericsson et al. . | |
| 3,543,454 | 12/1970 | Danin . | |
| 4,706,399 | 11/1987 | Martin . | |
| 4,845,869 | 7/1989 | Martin . | |
| 5,029,339 | 7/1991 | Caron . | |
| 5,305,926 | 4/1994 | Webb | 222/183 |

*Primary Examiner*—Philippe Derakshani
*Attorney, Agent, or Firm*—Sixbey Friedman Leedom & Ferguson; Thomas W. Cole

[57] ABSTRACT

An enclosure is provided having a first recessed portion for housing a public telephone, and a second recessed portion for housing at least one foodstuff vending machine that is receivable therein. A door-like protective wall is hingedly connected to a side edge of the second recessed portion for substantially enclosing and protecting the foodstuff vending machine. The vending machine is detachably connected to the back side of the door-like protective wall to facilitate access thereto. The protective wall includes a transparent window for displaying the contents of the foodstuff vending machine which is easily replaceable in the event of vandalism. Additionally, the foodstuff vending machine includes a horizontally oriented metering wheel with a single metering recess to make maximum use of the limited depth afforded by the second recessed portion.

17 Claims, 5 Drawing Sheets

ENCLOSURE FOR HOUSING AND DISPLAYING A PUBLIC TELEPHONE AND FOODSTUFF VENDING MACHINE

BACKGROUND OF THE INVENTION

This invention generally concerns an enclosure for housing, displaying, and affording easy access to both a public telephone and a foodstuff vending machine.

Enclosures for public telephones are well known in the prior art. While some of these enclosures take the form of booths with sliding glass doors that completely surround both the telephone and its user, the most common type of enclosure in use is a rectangular frame that defines an open, rectangular recess that surrounds and partially encloses such a telephone. A separate compartment may be provided at the bottom of such an enclosure for storing a telephone book. Sometimes the bottom wall of the frame of such an enclosure can function as a narrow shelf for the user to take notes or to arrange coins in preparation for the purchase of long distance telephone services. Such rectangular enclosures may either be mounted on a wall of a building, or rendered free standing by means of a pedestal. Such enclosures provide an inexpensive and space saving structure that provides some degree of privacy for the user while protecting the rear portion of the public telephone from access by vandals and the front portion from rain or other adverse weather conditions.

Vending machines for dispensing foodstuffs are also well known in the prior art. Such machines typically include a coin operated handle that is linked to a metering wheel which dispenses a portion of a foodstuff from a hopper. The front portion of the hopper is often transparent in order to display the contents of the machine. An example of such a machine is disclosed in U.S. Pat. No. Design 332,385. In this device, three different coin operated foodstuff vending machines are consolidated to offer the user a greater degree of choice. While such machines may be wall mounted, they are typically free standing on their own pedestals, as is illustrated in the '285 patent.

Applicants have observed that there is a need for an enclosure that is capable of both housing and displaying a public telephone and one or more foodstuff vending machines. However, the size and proportions of presently known foodstuff vending machines render them ill suited to be housed within the same enclosure. There are only two practical arrangements for any such combination enclosure, including placing the foodstuff machines to the side of the telephone, or above the telephone. Any enclosure that places the vending machine to the side of the telephone will often be too wide to fit into the spaces presently allotted for such enclosures. However, if one attempts to simply elongate the enclosure to accommodate a standard foodstuff vending machine above a public telephone, three other problems are created. First, few if any of such foodstuff vending machines are designed to be refilled, cleaned, or serviced when mounted in a frame that semi-encloses them. Hence the vending machine would have to be completely removed from the enclosure before a refilling operation could be commenced. Secondly, because of the semiprivate environment that such an enclosure affords to the user of the telephone, such vending machines are much more prone to be the targets of vandalism than solo vending machines. Thirdly, most vending machines have a much greater depth relative to the depth of a public telephone as a result of their use of a relatively wide, vertically-oriented metering wheel designed to receive and store a vended portion on one side while dispensing another such portion on another side. Consequently, such machines would tend to project into the head area of the telephone user, thus interfering with comfortable use of the telephone. The large depth of such prior art vending machines would further necessitate extending the depth of the upper portion of the walls of the enclosure if it is to effectively protect the vending machine from direct exposure to rain or other adverse weather conditions. Such a depth-wise wall extension would, of course, increase the expense of constructing the enclosure and cause it to take up larger amounts of space.

Clearly, there is a need for a combined enclosure that solves all of the aforementioned shortcomings associated with a simple mechanical combination of known telephone enclosures and foodstuff dispensing machines.

SUMMARY OF THE INVENTION

Generally speaking, the invention is a support structure connected to and extending above a public telephone for supporting at least one vending machine over said telephone, which may be a foodstuff dispenser, that overcomes all of the aforementioned shortcomings associated with a simple combination of these two devices.

The structure is preferably an enclosure that comprises a first recessed portion for partially enclosing a public telephone, and a second recessed portion located above the first for housing a foodstuff vending machine, and a wall pivotally connected to and detachably securable over the second recessed portion in door-like fashion for substantially enclosing, protecting, and removably supporting the foodstuff vending machine within the recess. The protective wall includes at least one window for displaying the contents of the foodstuff vending machine, and means for detachably mounting the window over an opening in the wall to facilitate its replacement in the event of vandalism.

The foodstuff vending machine is detachably mounted onto the door-like protective wall in order to facilitate access thereto when the protective wall is opened and swung away from the second recessed portion. Additionally, the vending machine includes a transparent hopper for holding a supply of foodstuff which is easily removable from the balance of the mechanism to facilitate the refilling and cleaning of the machine. To prevent foodstuff from falling out of the hopper during a refilling operation, the vending machine includes a flat, card-like retainer which may be inserted into a slot near the bottom of the hopper. Finally, in order to make the best use of the limited depth afforded by the enclosure, the metering wheel of the vending machine is a direct-drive, horizontally oriented cylinder having a single recess for receiving and metering a portion of foodstuffs.

BRIEF DESCRIPTION OF THE SEVERAL FIGURES

DETAILED DESCRIPTION OF THE PREFERRED EMBODIMENT

Figure 1:
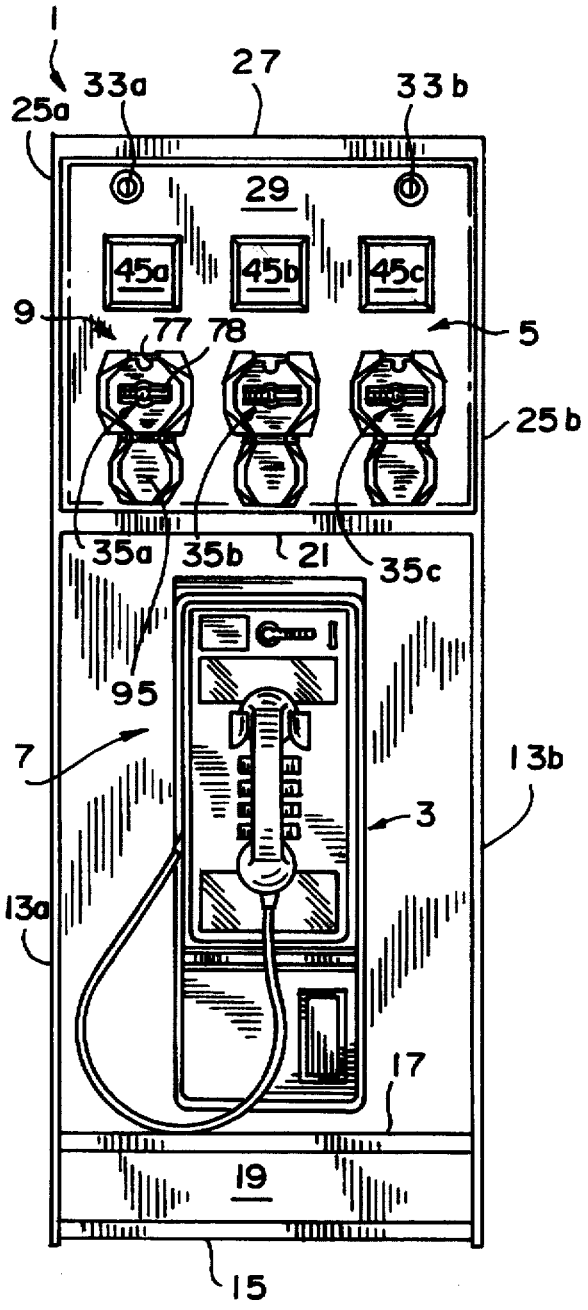
FIG. 1 is a from view of the enclosure for housing and displaying a public telephone and foodstuff vending machine of the invention.
Figure 2:
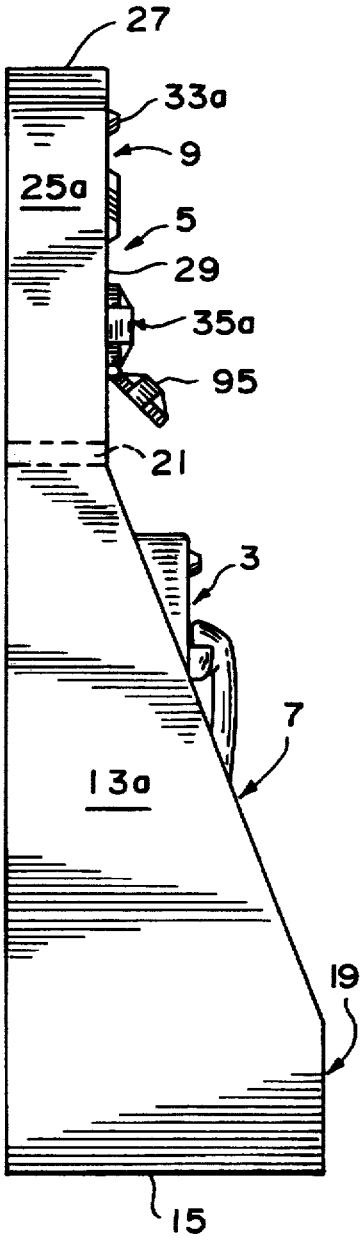
FIG. 2 is a side view of the enclosure illustrated in FIG. 1.

With reference now to FIGS. 1 and 2, wherein like components are designated with like numerals throughout all the several Figures, the invention generally comprises a rectangular enclosure 1 for housing and displaying both a public telephone 3 and a vending machine 5. The enclosure 1 includes an upper recessed portion 7 for housing and enclosing the vending machine 5, and a lower recessed portion 9 for housing and partially enclosing a public telephone 3. The lower recessed portion 9 is defined in part by a pair of opposing, trapezoidal sidewalls 13*a,b* that are interconnected along their lower edges by a bottom wall 15. A shelf 17 is disposed in parallel relationship above the bottom wall 15 for providing a small working area for the user of the telephone 3. A phone book storage area 19 is defined between the bottom wall 15 and shelf 17. An upper wall 21 disposed just above the top of the public telephone 3 defines the border between the upper and lower recessed portions 7 and 9. The upper recessed portion 7 is formed by a pair of rectangular sidewalls 25*a,b* that are interconnected at their bottom edges by means of the aforementioned wall 21, and at their top edges by way of top wall 27 to form a box-like structure.

Figure 3:
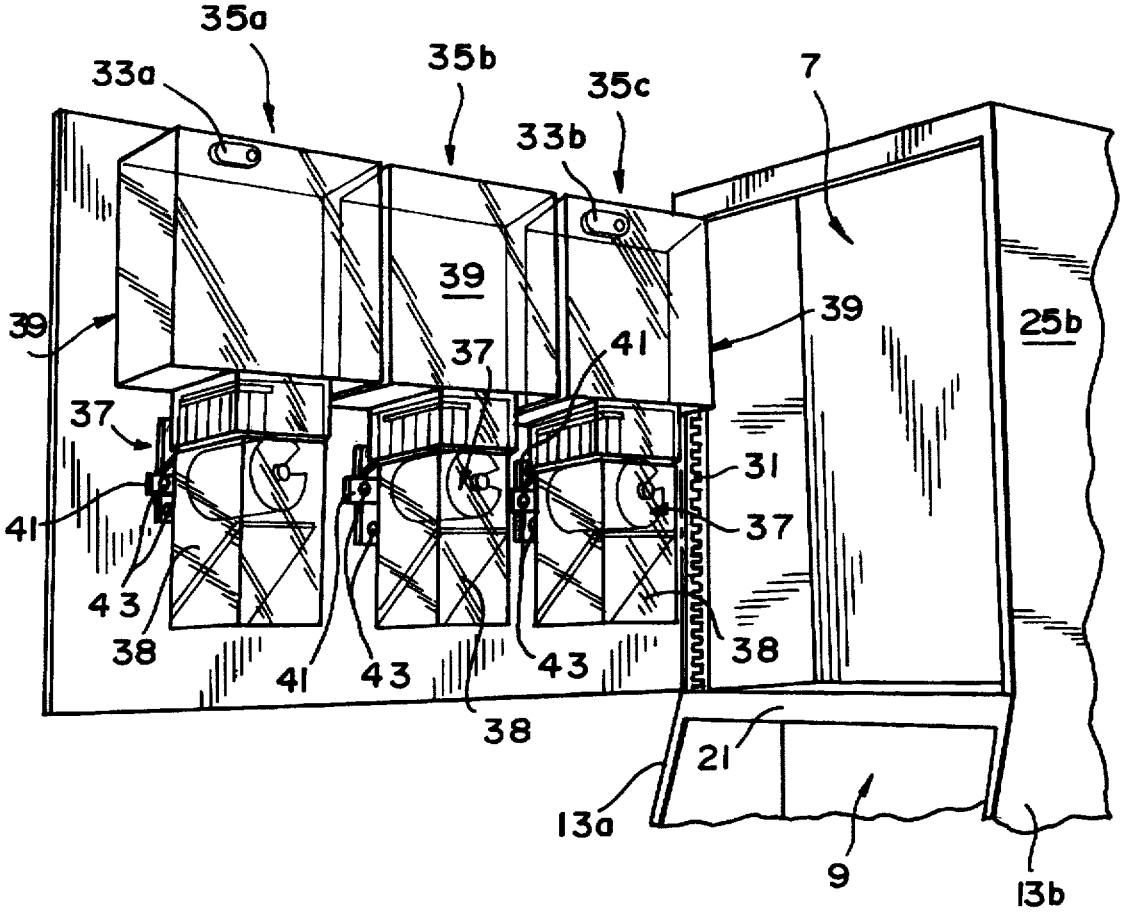
FIG. 3 is a partial perspective side view of the enclosure illustrated in FIG. 1 along the line 3—3 with the protective door swung 90° from the upper recessed portion of the enclosure.

A protective front wall 29 covers the box-like structure of the upper recessed portion 7. As is best seen in FIG. 3, the protective from wall 29 is connected along the edges of sidewall 25*a* by means of a hinge 31. Cylinder locks 33*a,b* are provided along the upper edge of the protective wall 29 for securing the wall 29 in a closed position over the upper recessed portion 7 of the enclosure 1. The components of the vending machine 5 are detachably connected onto the inner surface of the protective front wall 29 in order to facilitate easy access to the machine 5 when the cylinder locks 33*a,b* are opened and the wall 29 is swung out in door-like fashion. In the preferred embodiment, the vending machine 5 includes three separate foodstuff vending machines 35*a,b,c* as shown in order to afford the user of the telephone 3 a plurality of choices. As may best be seen in FIG. 4A, openings 36*a,b,c* are provided in the lower half of the protective wall 29 to provide access to the operating handles and dispensing doors of each of the foodstuff vending machines 35*a,b,c*.

Each of the foodstuff vending machines 35*a,b,c* includes a dispensing mechanism 37 having a boxlike housing 38 at its lower portion, and a transparent hopper 39 at its upper portion. Both the hoppers 39 and housing 38 of each of the machines 35*a,b,c* is preferably formed from a tough, transparent plastic such as polycarbonate. Each of the foodstuff vending machines 35*a,b,c* is detachably mounted onto the inner surface of the protective front wall 29 by means of brackets 41 and screws 43. The fact that the vending machines 35*a,b,c* are mounted onto the inner surface of the protective wall 29 easily allows access to the rear and side portions of each of these machines by merely opening and pivoting the front protective wall 29. The fact that each of the vending machines 35*a,b,c* can also be easily removed from the protective wall 29 via removal of the screws 43 provides quick and easy access to the front of these machines, should such access become necessary.

Figure 4B:
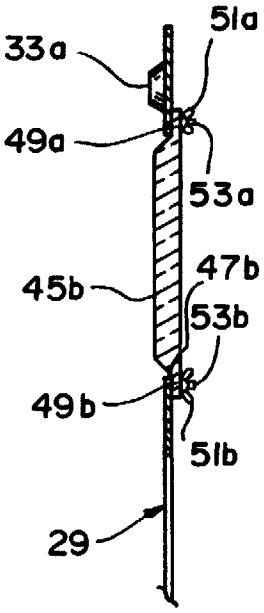
FIG. 4B is a side view of the protective wall of FIG. 4A along the line 4B—4B.
Figure 4A:
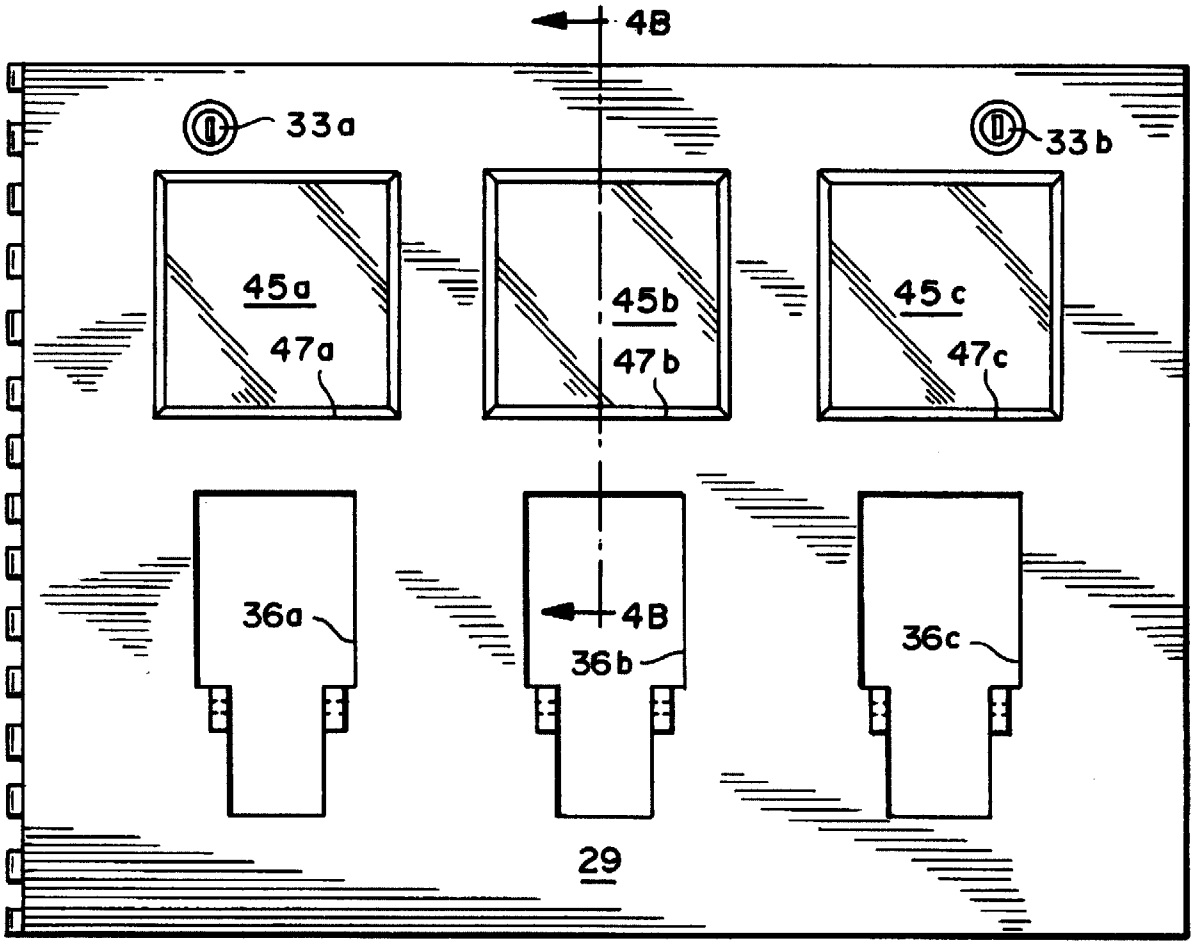
FIG. 4A is a front view of the protective wall of the invention detached from the enclosure.

With reference now to FIGS. 4A and 4B, the protective front wall 29 includes windows 45*a,b,c* which are detachably mountable over window openings 47*a,b,c*, one window being provided for each of the vending dispensers 35*a,b,c* in order to display the contents thereof. Preferably, each of the windows 45*a,b,c* is formed from a stiff, transparent plastic material, such as polycarbonate in order to resist scratching and other deliberate forms of vandalism. Each of the windows 45*a,b,c* further includes upper and lower window flanges 49*a,b* which allow them to be detachably mounted over their respective openings by means of wing nuts 51 and studs 53 (shown in FIG. 4B).

Figure 5A:
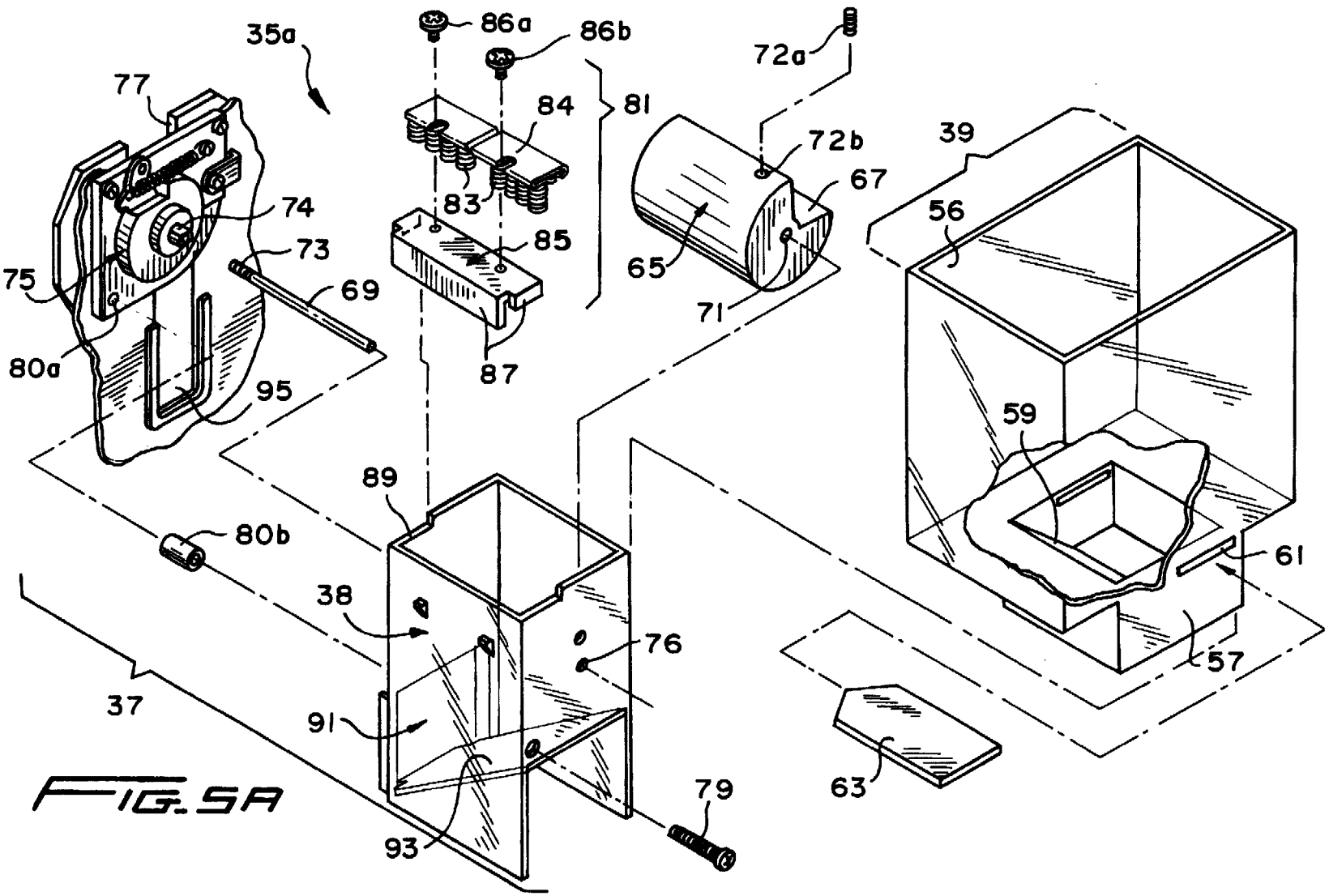
FIG. 5A is an exploded, perspective view of one of the foodstuff vending machines of the invention.
Figure 5B:
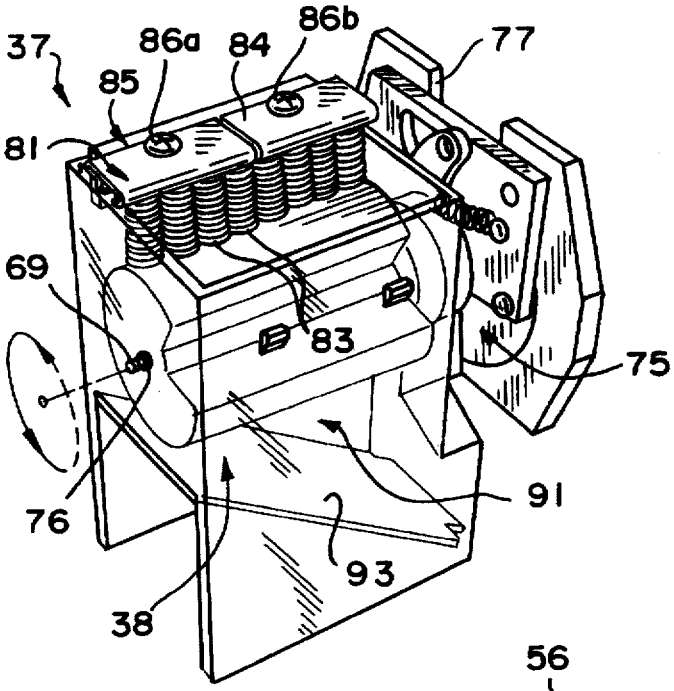
FIG. 5B is a perspective, assembled view of the dispensing mechanism of the vending machine illustrated in FIG. 5A.
Figure 6:
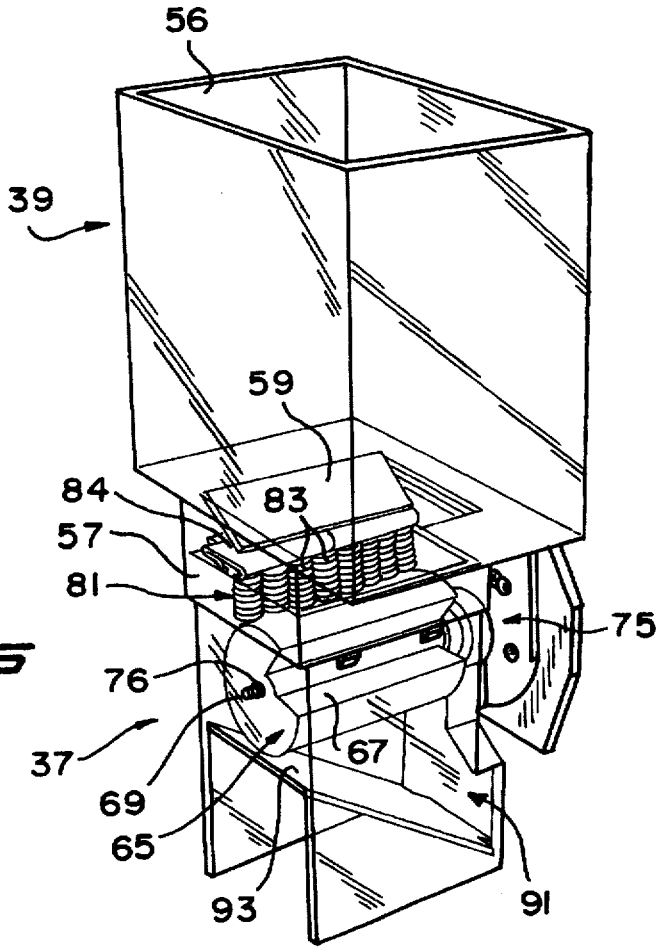
FIG. 6 is a rear perspective view of the vending machine illustrated in FIG. 5A.

With reference now to FIGS. 5A, 5B, and 6, the transparent hopper 39 of each of the vending dispensers 35*a,b,c* includes an open upper end 56 for receiving a supply of a foodstuff, and a lower rectangular neck 57 which may be slid over the top edge of the boxlike housing 38 of the dispensing mechanism 37. The neck 57 of each of the transparent hoppers 39 includes a funneling wall 59 that rests over a retaining assembly 81 which will be described shortly. Finally, the neck 57 includes a slot 61 for receiving a card-like retainer 63. The retainer 63 is inserted into the slot 61 to prevent foodstuffs from falling through the neck 57 during a filling or unfilling operation of the foodstuff dispenser 35*a,b,c*.

The dispensing mechanism 37 includes a cylindrical metering wheel 65 whose axis of rotation is horizontally oriented. The metering wheel 65 has a single pie-shaped recess 67 for receiving a portion of a foodstuff from the hopper 39 and conveying it to the chute portion 91 located in the lower half of the rectangular housing 38 of the dispensing mechanism 37. The metering wheel 65 is rotatably mounted in the upper portion of the rectangular housing 38 by means of an axle 65 that extends through a centrally located bore 71 (best seen in FIG. 5A). The wheel 65 is secured to the axle 69 by means of a set screw 72*a* threadedly engaged in a radially oriented bore 72*b*. The axle 69 has a threaded end 63 which is in turn screwed into a threaded nipple 74 attached to a coin operated lock wheel 75. The end of the axle 69 opposite the threaded end 73 is journaled in a circular opening 76 present in the upper portion of the box-like housing 38 of the dispensing mechanism 37. The front of the coin operated lock wheel 75 includes a slot 77 for receiving a coin, and an operating handle 78 for allowing the user to rotate the coin operated lock wheel 75, which in turn rotates the metering wheel 65. The back side of the lock wheel 75 is secured to the front face of the box-like housing 38 by means of a mounting screw 79 that engages a threaded bore 80*a* through cylindrical spacer 80*b* (see FIG. 5A). The coin operated lock wheel 75 is a commercially available component that does not, per se, constitute the instant invention.

As is best seen in FIGS. 5A and 5B, a retaining assembly 81 is mounted over the metering wheel 65 in order to assist the wheel 65 in controlling the size of the portion dispensed down the chute 91. To this end, the retaining assembly 81 includes a plurality of spring fingers 83 that wipingly engage the outer surface of the metering wheel 65 as it is rotated in the counterclockwise direction indicated in FIG. 5B. Each of the spring fingers 83 are mounted at their upper ends between opposing flanges of a spring bracket 84. The spring bracket 84 is in turn connected to a mounting bracket 85 by means of screw 86*a,b*. Bracket 85 includes downwardly extending flanges 87 which interfit over a cut-out portion 89 located along the upper edge of the box-like housing 38. As has been previously mentioned, the box-like housing 38 includes a chute 91 immediately below the metering wheel 65. The chute 91 has an inclined wall 93 for directing candy, gum, or other foodstuffs dispensed by the wheel 65 against the trap door 95 (shown in FIGS. 1 and 2) of one of the vending dispensers 35*a,b,c*.

In operation, the hopper 39 is filled with a coarse, particulate foodstuff (which may be small pieces of candy or gum) with the card-like retainer 63 disposed in the slot 61 to prevent the foodstuff from falling out through the open end of the neck 57. The hopper 39 is then placed on top of the box-like housing 38 of the dispensing mechanism 37 in the position illustrated in FIG. 6. The weight of the hopper 39 (and the foodstuffs it contains) presses down on the retaining assembly 81 so that the spring fingers 83 press against the outer surface of the metering wheel 65 in wiping engagement. When the retainer 63 is removed, the foodstuff inside the hopper flows through the neck 57 and completely fills the recess 67 of the wheel 65. When a user inserts a coin into the slot 77 and rotates the operating handle 78 of the lock wheel 75 in the counterclockwise direction illustrated in FIG. 5B, the spring fingers 83 of the retaining assembly 81 skim off any foodstuff that extends beyond the radius of the wheel 65 such that only the foodstuff trapped in the recess 67 is admired past the spring fingers 83. As the user continues to rotate the metering wheel 65, the foodstuff inside the recess 67 falls into the chute 91 as the recess 67 is inverted. When the user completes the rotation of the lock wheel 75, it reassumes the position illustrated in FIGS. 5B and 6 in readiness for the next dispensing cycle. The user then opens the trap door 95 to receive the metered portion of foodstuff paid for by the coin.

While the instant invention has been described with respect to a preferred embodiment, various modification, alternative embodiments, and improvements will become evident to persons of ordinary skill in the art. All such modifications, alternative embodiments, and improvements are intended to be encompassed within the scope of this invention, which is limited only by the claims appended hereto.

What is claimed:

1. An enclosure for housing and displaying both a public telephone and a foodstuff vending machine, comprising:

a first recessed portion for partially enclosing a public telephone;

a second recessed portion for housing a foodstuff vending machine;

a foodstuff vending machine receivable within said second recessed portion, and a wall means detachably securable over said second recessed portion for substantially enclosing and protecting said foodstuff vending machine while displaying the contents of said vending machine.

2. The enclosure of claim 1, wherein said wall means includes a window for displaying the contents of said foodstuff vending machine.

3. The enclosure of claim 2, wherein said wall means includes means for detachably mounting said window over an opening in said wall means to facilitate the replacement of said window.

4. The enclosure of claim 3, wherein said enclosure comprises a plurality of foodstuff vending machines receivable in said second recessed portion, and said wall means includes a plurality of windows for displaying the contents of each of said plurality of vending machines.

5. The enclosure of claim 3, wherein said foodstuff vending machine includes a hopper means for holding a supply of foodstuff to be dispensed including at least one transparent wall portion, and wherein said window abuts said transparent wall portion.

6. The enclosure of claim 1, wherein said foodstuff vending machine includes a hopper means for holding a supply of foodstuff to be dispensed by said machine, said hopper means being removable from said machine to facilitate the refilling thereof with a foodstuff.

7. The enclosure of claim 1, wherein said wall means is pivotally connected to an edge of said second recessed portion such that said wall means functions as a door over said second recessed portion.

8. The enclosure of claim 6, wherein said vending machine includes a retainer means for retaining foodstuffs in said hopper during a filling operation, said retainer means being slidably insertable in and removable from said hopper.

9. The enclosure of claim 1, wherein said foodstuff vending machine includes a rotatably mounted metering wheel for measuring a portion of a foodstuff in said machine, wherein said wheel is horizontally oriented along its axis of rotation.

10. The enclosure of claim 9, wherein said metering wheel includes a single recess for receiving and measuring said portion of foodstuff.

11. An enclosure for housing and displaying both a public telephone and a foodstuff vending machine, comprising:

a first recessed portion for partially enclosing a public telephone;

a second recessed portion for housing a foodstuff vending machine;

a foodstuff vending machine receivable within said second recessed portion, including a hopper means for holding a supply of foodstuff, said hopper having at least one transparent sidewall, and a wall means detachably securable over said second recessed portion for substantially enclosing and protecting said foodstuff vending machine while displaying the contents of said machine, said wall means including a transparent window for displaying the contents of said hopper means through said transparent hopper sidewall, and means for detachably mounting said window over an opening in said wall means to facilitate the replacement of said window.

12. The enclosure of claim 11, wherein said hopper means is removable from said vending machine to facilitate the refilling thereof with a foodstuff.

13. The enclosure of claim 12, wherein said vending machine includes a retainer means for retaining foodstuffs in said hopper means during a filling operation, said retainer means being slidably insertable in and removable from said hopper means.

14. The enclosure of claim 11, wherein said vending machine includes an operating handle attached to a horizontally oriented, rotatably mounted shaft, and a metering wheel for measuring a portion of a foodstuff in said hopper means of said vending machine, wherein said shaft is mounted along the axis of rotation of said metering wheel.

15. The enclosure of claim 4, wherein said metering wheel includes a single recess for receiving and measuring said portion of foodstuff.

16. The enclosure of claim 11, wherein said wall means is pivotally connected along one side to said second recessed portion and said vending machine is detachably mounted to said wall means to facilitate access to said vending machine incident to a refilling or servicing. operation.

17. Means for interconnecting at least two foodstuff vending machines and a public telephone to simultaneously display and provide access to both said vending machines and said public telephone, comprising a support means connected to and extending above said public telephone for supporting said foodstuff vending machines above said public telephone, and a wall means secured over both said foodstuff vending machines for protecting said machines, and including windows for displaying the contents of both of said machines.

* * * * *